US005454545A

United States Patent [19]

Taraldsson

[11] Patent Number: 5,454,545

[45] Date of Patent: Oct. 3, 1995

[54] SHUTTERING PANEL, CONTACT LAYER AND A METHOD FOR PRODUCING SHUTTERING PANELS

[76] Inventor: Leif B. Taraldsson, Minkvägen 60 s-9 39, Sollentuna, Sweden

[21] Appl. No.: 167,917

[22] PCT Filed: Jun. 25, 1992

[86] PCT No.: PCT/SE92/00473

§ 371 Date: Dec. 21, 1993

§ 102(e) Date: Dec. 21, 1993

[87] PCT Pub. No.: WO93/00494

PCT Pub. Date: Jan. 7, 1993

[30] Foreign Application Priority Data

Jun. 25, 1991 [SE] Sweden ..... 9101959

[51] Int. Cl.[6] ..... E04G 9/05

[52] U.S. Cl. ..... 249/115; 249/189; 264/31; 264/130; 427/359; 427/393; 427/408

[58] Field of Search ..... 249/114.1, 115, 249/189, 134; 264/129, 130, 134, 135, 31, 219; 427/359, 393, 408, 421; 428/76, 452, 537.1

[56] References Cited

U.S. PATENT DOCUMENTS

| | | | |
|---|---|---|---|
| 2,804,398 | 8/1957 | Hooks | 427/393 |
| 3,427,178 | 2/1969 | Zakim et al. | 249/115 |
| 3,650,795 | 3/1972 | Willingham | 249/189 |
| 3,656,994 | 4/1972 | Economy et al. | 427/359 |
| 3,759,481 | 9/1973 | Scott | 249/189 |
| 4,004,774 | 1/1977 | Houston | 249/189 |
| 4,037,816 | 7/1977 | Scott | 249/115 |
| 4,463,926 | 8/1984 | Bomberger | 249/192 |
| 4,562,103 | 12/1985 | Hering | 428/76 |

FOREIGN PATENT DOCUMENTS

| | | | |
|---|---|---|---|
| 401551 | 12/1990 | European Pat. Off. . | |
| 76349 | 9/1970 | German Dem. Rep. | 427/359 |
| 3117861 | 11/1982 | Germany | 249/189 |
| 62-144785 | 6/1987 | Japan | 427/393 |
| 1-192958 | 8/1989 | Japan | 427/393 |
| 464768 | 6/1991 | Sweden . | |
| 672650 | 12/1989 | Switzerland . | |
| 366914 | 6/1987 | U.S.S.R. | 249/115 |

*Primary Examiner*—Jay H. Woo
*Assistant Examiner*—Robert P. Davis
*Attorney, Agent, or Firm*—Nixon & Vanderhye

[57] ABSTRACT

A mould-form shuttering panel against which concrete is intended to be cast. The shuttering panel is wood based, such as plywood, wherein the side of the shuttering panel intended to lie in contact with the concrete includes an elastic layer which will not adhere to the concrete to any significant extent. The elastic layer is 1–5 mm in thickness and is applied to the plywood by a method including spraying the layer onto the plywood and then rolling a roller over the liquid coating.

20 Claims, No Drawings

SHUTTERING PANEL, CONTACT LAYER AND A METHOD FOR PRODUCING SHUTTERING PANELS

The present invention relates to a concrete-form shuttering panel against which concrete is intended to be cast.

The invention also relates to a shuttering-panel contact layer and to a method for manufacturing shuttering panels.

Shuttering panels of this general kind are known. One problem experienced when concreting in this way resides in the difficulty of releasing the shuttering panels from the setting concrete after concreting. It is known to apply so-called form oil to the panel surface facing towards the concrete, prior to casting the concrete. This is expensive, however, owing to the time consumed in applying the oil and also due to the cost of the material consumed, and is also undesirable from an environmental aspect. Present-day shuttering panels are normally wood based, for instance plywood panels, among other things for reasons of cost and mechanical strength. Another advantage afforded by the use of wood-based panels is that they can be nailed. The known panels often have a surface coating, e.g. a plastic film coating, which is baked on the wood surface, or a plastic laminate which is glued onto the wood surface, or a plastic material reinforced with fibre glass. However, despite the presence of this surface coating, it is necessary to apply large quantities of form oil in order to enable the panel to be released from the concrete. One serious drawback with known wood-based panels is that the nail holes are permanent and allow moisture to enter the wooden panel, causing the panel to rot quickly.

The present invention relates to a shuttering panel and to a contact layer which solves the above-related problems.

Accordingly, the invention relates to a concrete-form shuttering panel against which concrete is intended to be cast and which is preferably wood-based, such as plywood, and therewith nailable.

The shuttering panel is mainly characterized in that the side of the panel which is intended to lie in contact with the concrete includes an elastic layer which will not adhere to the concrete to any significant extent.

The invention also relates to a contact layer for concrete-form shuttering panels, said contact layer being intended to lie against the cast concrete.

The contact layer is mainly characterized by an elastic layer which is intended not to adhere to the concrete to any significant extent.

The invention also relates to a method for manufacturing a concrete-form shuttering panel against which concrete is intended to be laid and which is preferably wood-based, such as so-called plywood, and which is provided on the side thereof intended for contact with the concrete an elastic layer which will not adhere to the concrete to any significant extent.

The method is mainly characterized by applying liquid elastic-layer forming material to one surface of a shuttering panel, preferably with the aid of one or more spray nozzles, and rolling the layer material to a desired thickness with the aid of a roller, such as a steel roller, wherein a release agent, such as a layer of Teflon®, is preferably applied between the roller and the liquid contact-layer forming material.

The invention will now be described in more detail with reference to an exemplifying embodiment thereof.

The inventive shuttering panel is thus preferably wood-based, i.e. is comprised mainly of wood, such as so-called plywood, and the side of the panel which is intended to lie in contact with the concrete is provided with an elastic layer which will not adhere to the concrete to any significant extent, the layer material being chosen against this background. It has been found that some plastic materials possess properties which enable concrete to be laid in contact with these materials without the materials binding or adhering to the concrete. This enables the material to be quickly and easily separated from the concrete when the concrete has set.

According to preferred embodiments, the layer is formed from a polymer-based material, a rubber-based material or the like.

Preferred materials are those which are able to withstand temperatures considerably beneath 0° C., i.e. materials which will not freeze. Examples of such materials which, in addition to the aforesaid properties, will not adhere to hardened concrete but can be readily loosened therefrom, is a polymer-based material retailed under the trademark BAYTEC, designated 0308 and manufactured by Bayer Chemie, Germany, and a similar polymer-based material which is retailed under the trademark ADIPRENE, designated RFA and manufactured by du Pont, U.S.A.

Suitable elastic materials have a Shore-hardness A of 60–90, preferably 70–18.

The surface of the shuttering panel onto which the elastic layer, or coating, is to be applied is preferably treated with a so-called primer before applying the elastic layer, this primer functioning to seal the wood and to prevent air from exiting from the wood during application of the layer. According to one such embodiment, the primer used is a material retailed under the trademark PLIO GRIP, designated 6036, and manufactured by Ashland Chemicals Corp., U.S.A.

According to one embodiment, which is preferred in some instances, the elastic material from which the contact layer is formed includes a so-called plasticizer, such as essentially dioctyl phthalate, which provides the contact layer with a surface having further improved release properties with regard to concrete.

According to one method for manufacturing shuttering panels provided with elastic concrete-contact layers, the material from which the elastic layer is formed is applied in a liquid state, preferably by means of one or more spray nozzles, onto a primer-treated panel surface and is rolled to a desired layer thickness with the aid of a roller, such as a steel roller, wherein a release agent, such as a polytetrafluoroethylene coating, is preferably applied between the roller and the applied liquid layer-forming material, whereafter the polytetrafluoroethylene coating is then preferably removed. Preferably, at least some of the edge surfaces of the panel, such as the surfaces located at right angles to the roller axis, are provided with frame parts which extend above the panel surface to be coated through a distance which corresponds to the desired thickness of the contact layer, said frame work forming roller spacing means during a rolling operation. The panel will also preferably slope downwards in the direction in which the contact layer is rolled out, for instance at an angle from 1°–2° in relation to the horizontal plane.

According to one embodiment, the layer has a thickness of about 1–5 mm, preferably from 2–4 mm.

According to one embodiment, the contact layer is glued to a supporting panel body.

The function of an inventive shuttering panel and an inventive contact layer, and also the inventive method will be understood in all essentials from the aforegoing. The elasticity of the layer and its surface properties ensure that the shuttering panel can be released relatively easily from the concrete. The layer is pressed against the panel by the pressure exerted by the concrete as it expands, as a result of its elastic resilience of the layer when the concrete has set and the form is stripped.

It will also be obvious from the aforegoing that the invention affords important advantages over the known prior art. A large number of concrete constructions can be laid while using one and the same layered shuttering panel, thereby achieving considerable savings in material (form oil) and working time. In addition, the time taken to strip the form is reduced by the fact that the form can be readily removed from the concrete structure. In addition, the shuttering panel can be nailed and the contact layer is "self-healing", i.e. the nail holes are "healed" automatically when the nails are withdrawn, due to the elastic resilience of the contact layer.

The invention has been described in the aforegoing with reference to exemplifying embodiments thereof. It will be understood, however, that other embodiments and minor modifications are conceivable within the concept of the invention.

For instance, the term shuttering panel as used here shall be given a wide interpretation and not considered limited to straightforward panels, but can also be considered to include, for instance, cylindrical configurations and form elements in which more elements than a shuttering panel are integrated to form an assembly.

It is preferred to treat the panel surface that has not been provided with a contact layer, thus the surface remote from the concrete, with a preservative substance, such as Cuprinol (registered trademark) which will allow moisture to depart from the panel.

It will also be understood that materials other than the above-mentioned BAYTEC, ADIPRENE, PLIO GRIP and dioctyl phthalate, having generally corresponding properties can be used when applying the invention, where BAYTEC and ADIPRENE are mouldable, polymer-based materials of synthetic rubber type.

The invention is thus not restricted to the aforedescribed exemplifying embodiments thereof, since modifications and variations can be made within the scope of the following claims.

I claim:

1. A concrete-form shuttering panel comprising:

a panel of plywood having a first major side face against which concrete will be laid; and a contact layer disposed on said first side face and connected thereto, said contact layer having a thickness of 1–5 mm and being of a resilient rubber-based material which will not adhere to concrete that comes into contact therewith so that after concrete cast using said panel hardens, said panel and contact layer may be moved out of contact with the hardened concrete.

2. A panel as recited in claim 1 wherein said contact layer has a thickness of 2–4 mm.

3. A panel as recited in claim 2 wherein said contact layer material has a Shore-hardness A of 60–90.

4. A panel as recited in claim 2 wherein said contact layer material has a Shore-hardness A of 70–80.

5. A panel as recited in claim 4 wherein said contact layer material includes a plasticizer in a sufficient quantity to improve the concrete-release properties of said contact layer.

6. A panel as recited in claim 3 further comprising a primer between said first panel side face and said contact layer for preventing air from exiting from said first panel side face during construction of said panel.

7. A panel a recited in claim 1 wherein said contact layer material has a Shore-hardness A of 60–90.

8. A panel as recited in claim 1 wherein said contact layer material has a Shore-hardness A of 70–80.

9. A panel as recited in claim 1 wherein said contact layer material includes dioctyl phthalate plasticizer in a sufficient quantity to improve the concrete-release properties of said contact layer.

10. A method of manufacturing a concrete-from shuttering panel, from a piece of plywood having a first major side face, comprising the steps of sequentially:

(a) spraying a resilient material which will not adhere to concrete on the first major side face of the piece of plywood to form a liquid layer;

(b) using a roller having a release agent coating, rolling over the liquid layer to form a desired thickness of resilient material on the first face; and (c) drying the liquid layer to form a shuttering panel of plywood having a contact layer with a desired thickness of resilient material adapted to be brought into engagement with non-hardened concrete, and separated from the concrete after it has hardened.

11. A method as recited in claim 10 wherein steps (a)–(c) are practiced to form a contact layer having a thickness of 1–5 mm.

12. A method as recited in claim 11 comprising the further step, prior to step (a), of treating the first side face of the piece of plywood with a primer to prevent air from exiting the first side face during the practice of steps (a)–(c).

13. A method as recited in claim 10 wherein step (b) is further practiced by providing spacers extending outwardly from the first face of the piece of plywood a distance corresponding to said desired thickness of the contact layer, and rolling the roller along the spacers.

14. A method as recited in claim 10 wherein steps (a)–(c) are practiced to form a contact layer having a thickness of 2–4 mm.

15. A method as recited in claim 10 comprising the further step, prior to step (a), of treating the first side face of the piece of plywood with a primer to prevent air from exiting the first side face during the practice of steps (a)–(c).

16. A method as recited in claim 11 wherein step (b) is further practiced by providing spacers extending outwardly from the first face of the piece of plywood a distance corresponding to said desired thickness of the contact layer, and rolling the roller along the spacers.

17. A method as recited in claim 16 comprising the further step (d), during the practice of step (b), of sloping the piece of plywood downwardly, and wherein step (b) is practiced to roll the contact layer in the direction of the downward slope.

18. A method as recited in claim 17 wherein step (d) is practiced to slope the piece of plywood downwardly at an angle of about 1 degree–2 degrees to the horizontal.

19. A method of manufacturing and using a concrete-from shuttering panel, from a piece of plywood having a first major side face, comprising the steps of sequentially:

(a) spraying a resilient material which will not adhere to concrete on the first major side face of the piece of plywood to form a liquid layer;

(b) forming the liquid layer to a desired thickness of resilient material of 1–5 mm on the first face;

(c) drying the liquid layer to form a shuttering panel of plywood having a contact layer with a desired thickness of resilient material;

(d) bringing non-hardened concrete into engagement with the contact layer;

(e) allowing the concrete to harden; and (f) removing the panel, including contact layer, out of engagement with the hardened concrete.

20. A method as recited in claim 19 wherein steps (a)–(c) are practiced to form a contact layer having a thickness of 2–4 mm.

* * * * *